US007628746B2

(12) United States Patent
Varanasi

(10) Patent No.: US 7,628,746 B2
(45) Date of Patent: Dec. 8, 2009

(54) SHIPPING AND DISPLAY CARTON

(75) Inventor: Aditya Varanasi, Plano, TX (US)

(73) Assignee: Frito-Lay North America, Inc., Plano, TX (US)

( * ) Notice: Subject to any disclaimer, the term of this patent is extended or adjusted under 35 U.S.C. 154(b) by 737 days.

(21) Appl. No.: 11/609,582

(22) Filed: Dec. 12, 2006

(65) Prior Publication Data

US 2007/0082797 A1 Apr. 12, 2007

Related U.S. Application Data

(62) Division of application No. 10/653,742, filed on Sep. 2, 2003, now Pat. No. 7,175,066.

(51) Int. Cl.
*B31B 1/00* (2006.01)

(52) U.S. Cl. ..... 493/52; 493/63; 493/86; 493/79

(58) Field of Classification Search ..... 493/52, 493/63, 70, 79, 76, 82, 83, 86
See application file for complete search history.

(56) References Cited

U.S. PATENT DOCUMENTS

| | | | |
|---|---|---|---|
| 1,864,968 | A | 6/1932 | Weiner |
| 2,152,079 | A | 3/1939 | Mott |
| 2,457,291 | A | 12/1948 | Wenzel |
| 3,111,255 | A | 11/1963 | Skowronski |
| 3,139,979 | A | 7/1964 | Russell |
| 3,315,875 | A | 4/1967 | Praetorius |
| 3,324,999 | A | 6/1967 | Farquhar |
| 3,347,356 | A | 10/1967 | Kossnar |
| 3,355,089 | A | 11/1967 | Champlin |
| 3,542,192 | A | 11/1970 | Steck |
| 3,653,495 | A | 4/1972 | Gray |
| 3,829,006 | A | 8/1974 | Spiegel |
| 4,000,811 | A | 1/1977 | Hardison et al. |
| 4,008,849 | A | 2/1977 | Baber |
| 4,053,101 | A | 10/1977 | Hart |
| 4,058,206 | A | 11/1977 | Morse et al. |
| 4,113,100 | A | 9/1978 | Soja et al. |
| 4,153,158 | A | 5/1979 | Graser et al. |
| 4,213,559 | A | 7/1980 | Meyers |
| 4,382,511 | A | 5/1983 | Hamelin et al. |
| 4,553,666 | A | 11/1985 | Gullikson |
| 4,778,059 | A | 10/1988 | Martin et al. |
| 4,905,837 | A | 3/1990 | Schuster et al. |
| 5,048,690 | A | 9/1991 | Zimmerman |
| 5,197,660 | A | 3/1993 | Colling |
| 5,332,150 | A | 7/1994 | Poirier |
| 5,413,276 | A | 5/1995 | Sheffer |

(Continued)

FOREIGN PATENT DOCUMENTS

GB 2088830 A 6/1982

*Primary Examiner*—Sameh H. Tawfik
(74) *Attorney, Agent, or Firm*—Colin P. Cahoon; Chad E. Walter; Carstens & Cahoon, LLP

(57) ABSTRACT

A shipping carton is converted to use as a display carton using perforated lines and precut openings that together define a line circumscribing the carton. At any location at which the perforated line crosses an edge of the carton of another perforated line, a precut opening provides a clean separation. Additionally, no section of the perforated lines parallels an adjacent fold line.

7 Claims, 4 Drawing Sheets

U.S. PATENT DOCUMENTS

| | | | |
|---|---|---|---|
| 5,505,371 | A | 4/1996 | O'Neill |
| 5,524,815 | A | 6/1996 | Sheffer |
| 5,651,497 | A | 7/1997 | Ventura et al. |
| 5,826,728 | A | 10/1998 | Sheffer |
| 5,921,398 | A | 7/1999 | Carroll |
| 5,979,662 | A | 11/1999 | Green |
| 6,435,351 | B1 | 8/2002 | Gibb |
| 6,832,683 | B2 | 12/2004 | Boriani et al. |

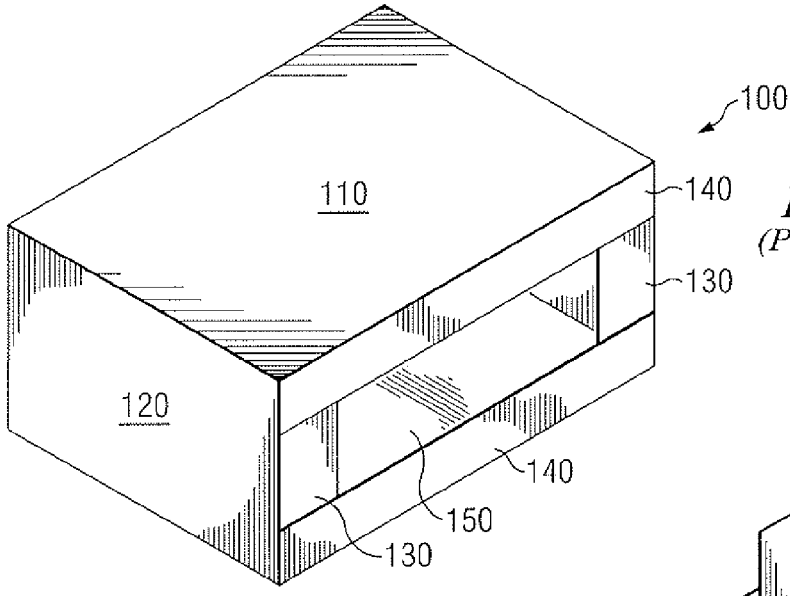
FIG. 1a
(PRIOR ART)
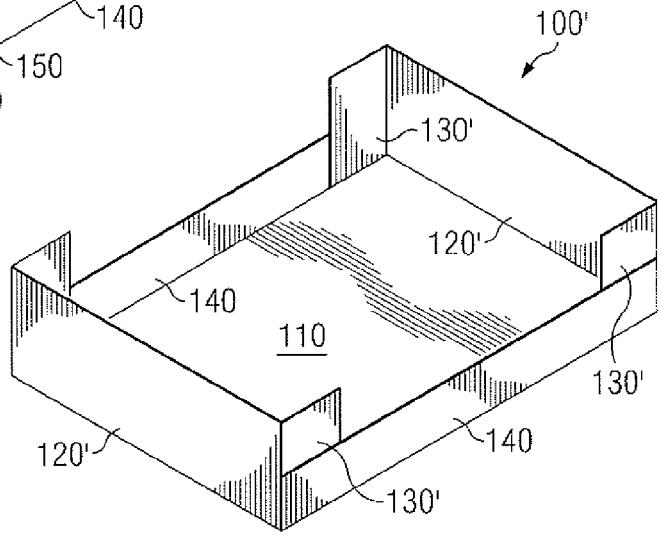
FIG. 1b
(IDEALIZED PRIOR ART)
FIG. 2a
(PRIOR ART)
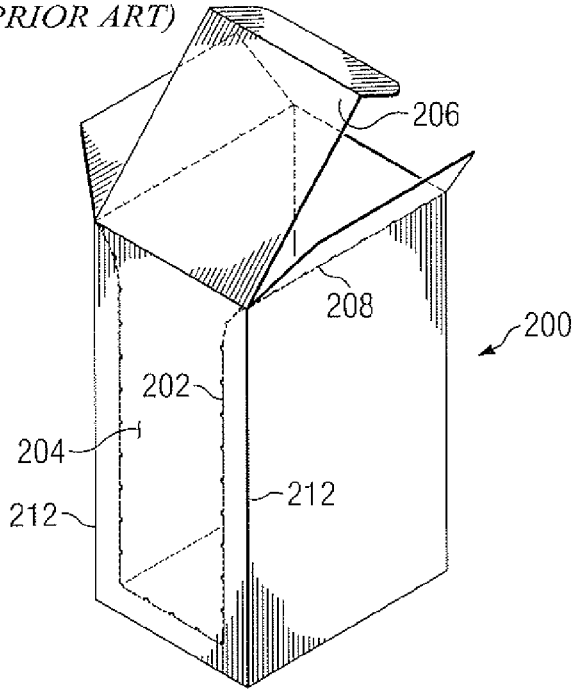
FIG. 2b
(PRIOR ART)
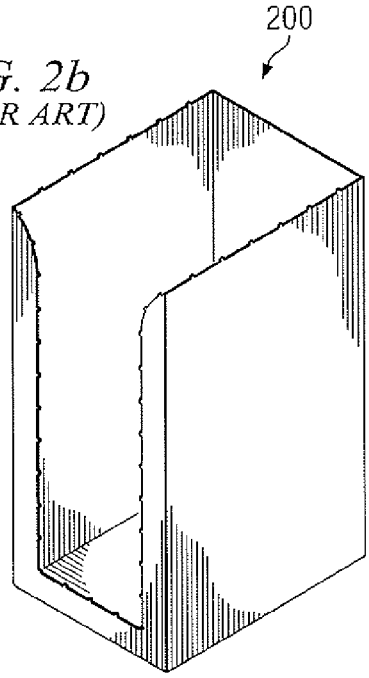

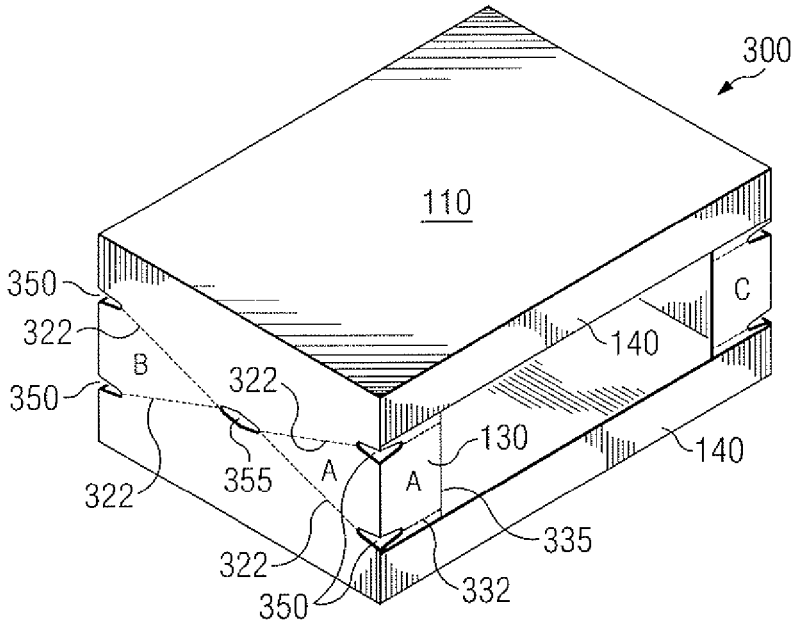
FIG. 3a
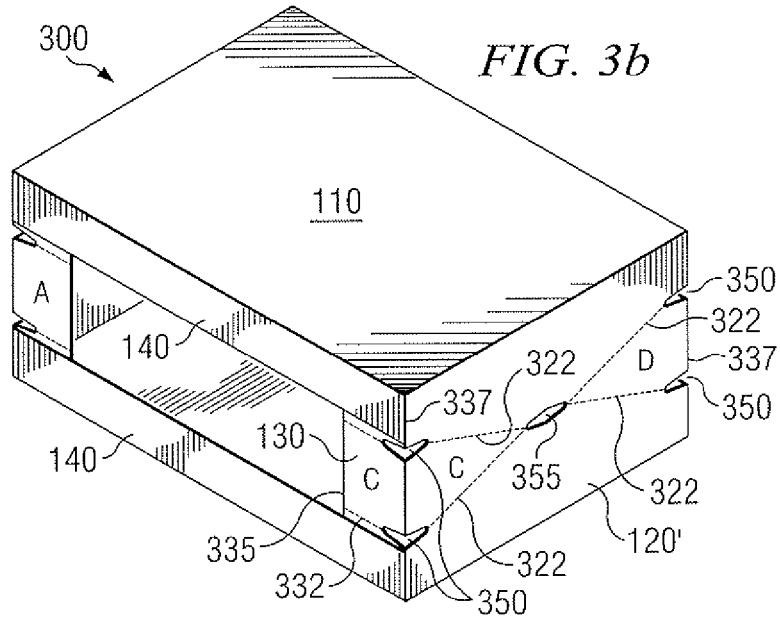
FIG. 3b
FIG. 3c
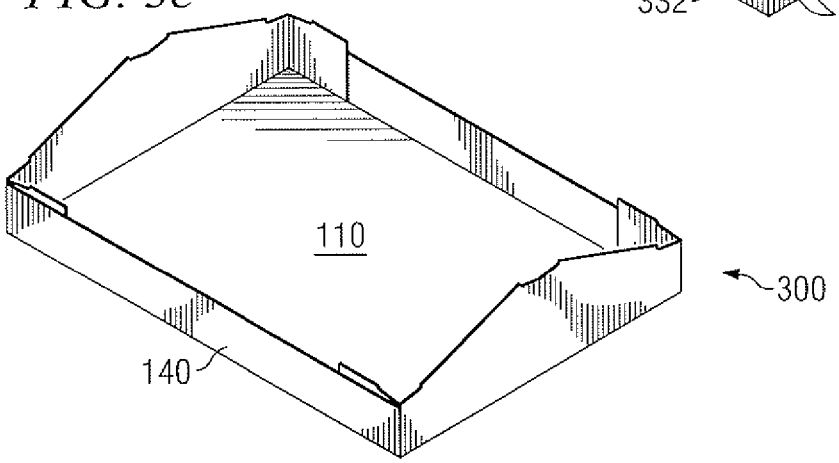

SHIPPING AND DISPLAY CARTON

This application is a divisional of U.S. application Ser. No. 10/653,742 entitled "Shipping and Display Carton" filed on Sep. 2, 2003.

BACKGROUND OF THE INVENTION

1. Technical Field

The present invention relates generally to a shipping and display carton. More specifically, the invention relates to a slipping carton, and a method of making a shipping carton, that is easily transformed into a display carton having neatly severed walls.

2. Description of Related Art

Millions of dollars are spent each year in packaging products for transportation from the manufacturer to the store. Rather than require these products to be removed from the container and individually placed on shelves, it has long been desirable to ship products in cartons that can quickly be converted to provide a display format. Because of the variety of products and their differing needs, many different types of shipping and display cartons have been made. Examples of combination shipping and display cartons can be found in U.S. Pat. No. 2,152,079 to Mott, U.S. Pat. No. 3,315,875 to Praetorius, U.S. Pat. No. 4,000,811 to Hardison et al., and U.S. Pat. No. 5,826,728 to Sheffer, to name a few, all of which are incorporated by reference. Each of these patents attempts to provide a convertible carton that will provide adequate protection for its contents during shipping, then transform into an aesthetic display carton.

By far the most common material used for shipping/display cartons is corrugated cardboard. This material is strong, lightweight, relatively inexpensive, and recyclable. When converting a corrugated shipping carton into a display carton, it would be desirable to have a carton that is easy to open, yet presents a pleasing appearance without inadvertent tears. Several means already exist that attempt to achieve this goal, although all have drawbacks. These drawbacks will be further explained using an exemplary carton, shown in FIG. 1*a*.

FIG. 1A shows a prior art design for a shipping and display carton 100 that has the shape of a rectangular prism measuring about 9¼×19½×9½ inches. The carton has four solid sides: top and bottom panels 110 and two end panels 120. Two short flaps 130 extend from the end panels 120 and two long flaps 140 extend from top and bottom panels 110. The two long flaps 140 are sized so that they do not meet to completely close the box; rather, all the flaps 130, 140 together frame an opening 150 in the carton, with overlapping flaps 130, 140 in each corner. Tape can be wrapped from the long flaps 140 to the ends 120 to seal and stabilize the carton, or the overlapping flaps 130, 140 can be glued or otherwise fastened together to seal the carton. This carton design is used for shipping lightweight containers of snack foods, such as chips. To convert the carton to display, the stocker removes the top half or two-thirds of the carton by cutting a line completely across each of the short flaps 130 and end panels 120. This creates a tray 150 having short edges that hold the product in place yet provide high visibility to consumers. FIG. 1B presents an idealized conversion to a display carton 100' with perfectly straight edges that neatly bisect panels 120 and 130 to create shortened sides 120' and 130'. The ability to make this neat of a transformation is desirable, but rarely obtainable. Often, the person stocking the product is in a hurry, so the actual cuts are rarely this straight or this neat. Further, the stocker must carry a knife and must take care not to cut the product during the process of converting the carton to display. In other carton designs, extra layers of cardboard are sometime included beneath the cut lines; these layers are used to protect the product during cutting, but add to the expense.

One alternative to cutting the carton is to use special tear strip tapes, such as those offered by 3M Corporation. These tapes can be used to make an easy-to-open carton that has a neat appearance, but they add significantly to the cost of the carton.

A third alternative is to provide perforations in the cardboard itself so that sections of the carton can be quickly removed for display. This method is inexpensive, but has problems of its own. FIGS. 2*a* and 2*b* are taken from U.S. Pat. No. 3,315,875 to Praetorius and demonstrate a prior art method of turning a shipping carton 200 into a display carton 200'. Perforated lines 202 make a U-shape, defining a removable strip 204 that includes the larger flap 206 of the lid. Additional perforated lines 208 allow the smaller flaps 210 to be removed, creating the open display carton 200'. However, it can be difficult to obtain a clean tear. This is especially true at the edges of the carton, where the tear has to turn a corner. The strength of the cardboard is enhanced by the adjacent wall, so additional force is needed to tear. At the same time, the direction of the force needs to change abruptly; it is difficult to provide the extra force in a controllable manner. Too often tearing across a corner results in ragged edges that are less appealing. Additionally, the perforations create weakened sections of the carton that can accidentally tear, often when the package is being assembled. The carton of FIG. 2*a* is exemplary of this. When the blank is being folded to form the carton, care must be taken when making the vertical folds 212; otherwise the cardboard may accidentally fold along the weakened line of perforations 202, further weakening the line of perforations 202 and causing premature tearing. Likewise, the folds at the base of flaps 210 are weakened by the perforated lines 208. The pre-mature removal of the flaps 210 would leave a gap in the shipping carton 200. Because of these problems, this method has thus far proved to be inexpensive but less than ideal.

Consequently, it would be desirable to have a carton that is easily convertible from a shipping carton to a display carton, presents a neat, pleasing appearance for display, does not tear prematurely, requires no tools, and adds little or nothing to the cost of making the carton.

SUMMARY OF THE INVENTION

Difficulties with using perforated lines to remove sections of a carton are related to two problem areas: 1) having a line of perforations that parallel a nearby folding line and 2) the difficulty in tearing a perforated line that crosses an edge of the carton. In recognizing these problem areas, the invention sets as design criteria that a) no perforated line should parallel an adjacent fold line in the design and b) if a line of perforations crosses an edge of the carton, a precut opening should be provided at the juncture.

With these design criteria, it is possible to design a carton that meets all the desirable criteria discussed. The carton can be converted to display by removing one or more sections of cardboard bounded by perforated lines, using no tools. The difficulty in tearing around edges of the carton is removed by the pre-cut openings, permitting a neat, pleasing appearance. Because the perforated lines do not parallel adjacent fold lines, premature tearing is lessened or eliminated. Finally, this is a change in design that does not add to the cost of manufacturing the carton.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 1*a* depicts a prior art design for a shipping and display carton; FIG. 1*b* shows an idealized version of that same carton after conversion to display;

FIGS. 2*a* and 2*b* depict a prior art carton having perforations to aid in separating sections of the carton;

FIGS. 3*a* and 3*b* depict two views of a shipping and display carton according to a preferred embodiment of the invention, FIG. 3*c* shows the carton of FIGS. 3*a* and 3*b* after conversion to a display carton;

DETAILED DESCRIPTION

Figure 4:
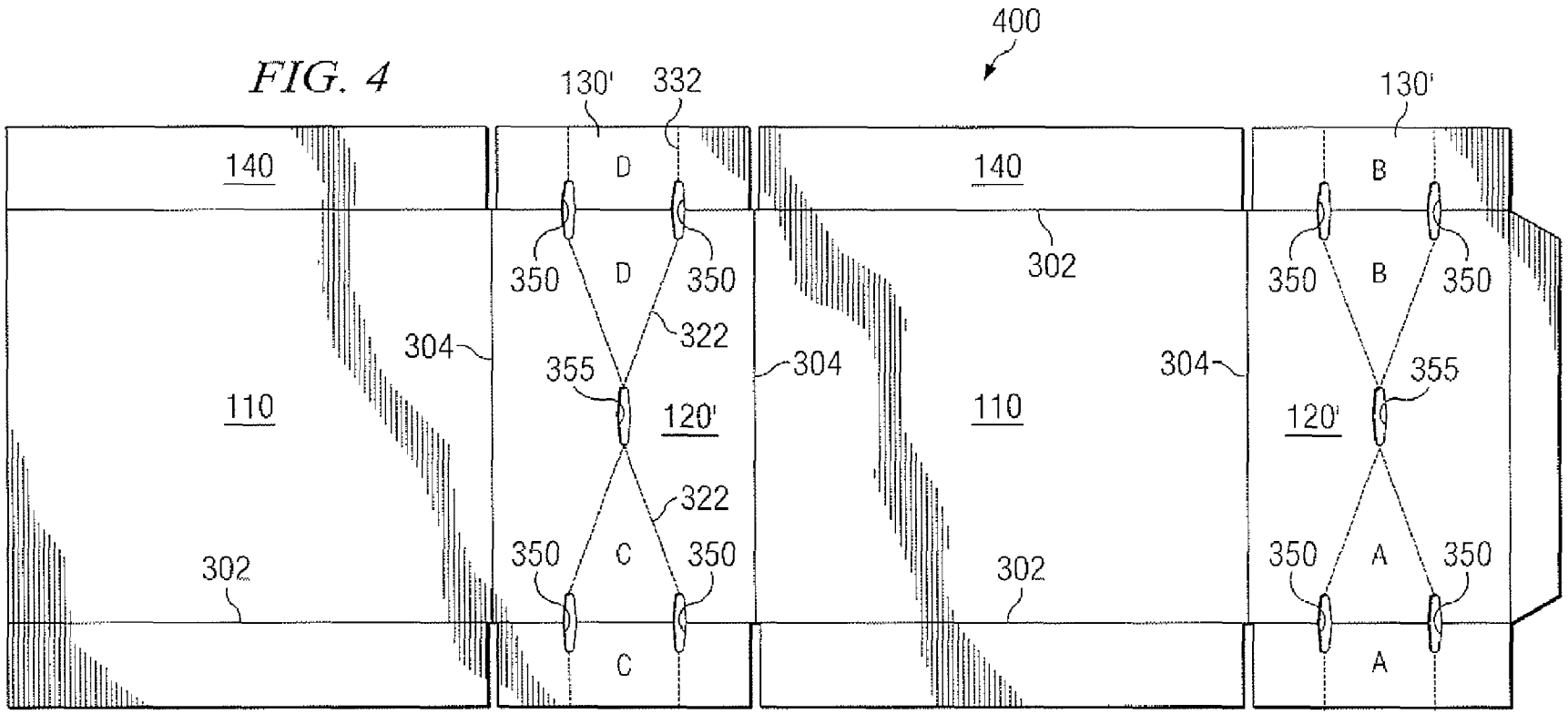
FIG. 4 depicts the layout for the shipping and display carton of FIGS. 3*a* and *b*.

FIGS. 3*a* and 3*b* show a shipping and display carton according to a preferred embodiment of the invention. This carton 300 has the same basic shape as the prior art cartons 100 of FIGS. 1*a* and 1*b*, but uses the guidelines set forth above, namely that a) no perforated line should parallel an adjacent a fold line in the design and b) if a line of perforations crosses an edge of the carton, a precut opening should be provided at the Juncture. Unless otherwise noted, identical element numbers used in common between drawings are to substantially similar elements in the drawings. As seen in FIGS. 3*a* and 3*b*, which are views from opposite ends of the carton, perforated line 332 runs from one edge 335 of the flap 130 almost to the edge 337 of the carton, where it terminates in a precut hole 350. The precut holes 350 wrap around the corner, so that there is no need to tear around a corner, the most common place for an accidental tear to happen. Perforated lines 322 run from each of four precut holes 350 to meet in another precut hole 355 in the center of the end panel 120. In this embodiment, the precut holes 350, 355 each have a width that ranges from ¼ to ⅝ inches and a length of 2¼ inches. A stocker need only grab the edge 335 of flap 130 and pull to quickly and cleanly separate section A from the rest of the carton. Four such moves and each of the corresponding sections B, C, D is removed, leaving the lower portion of the carton as a display tray 300', as seen in FIG. 3*c*.

In order to keep the tears along the perforated lines clean, the perforations and lands (spaces between the perforations) should both be in the range of ⅛ to ½ inches each. In the specific embodiment shown, the perforations are ¼ inch, while the lands are 3/16 inch. Additionally, at the beginning of each perforation line, the beginning perforation is longer, in the range of ½ to 1 inch in length, to be sure that the tear starts well. In the embodiment shown, the leading perforation is ¾ inch. These dimensions allow the cardboard to tear neatly, but provide enough strength to the carton that it will remain intact during shipping.

A blank for a corrugated cardboard box refers to the flat sheet of cardboard that has been cut into a necessary design and scored so that it will fold most easily along the desired lines. A blank is formed by a rotating die that can cut, score for fold lines, and perforate a sheet of corrugated cardboard in a single pass. FIG. 4 depicts a blank that can be assembled into the carton of FIG. 3*a*. Since all cuts and folding lines are made at the same time, the addition of the perforated lines and precut holes does not affect the cost of production. A manufacturer switching from making the box of FIG. 1*a* to the box of FIG. 3*a* would have to have changes made in the die used to make the boxes, but no additional costs beyond the die. As can be seen from FIG. 4, this is a purposefully simple design. Long fold lines 302 run the length of the pattern, between the flaps 130,140, and the body 110, 120'. From this perspective, it is clear that none of the perforated lines parallel "adjacent" fold lines. For the purposes of this disclosure, fold lines are considered "adjacent" to perforated lines if they are not separated from the perforations by a cut or other fold line. Thus, perforation lines 332 run parallel to the fold lines 304, but these lines are not adjacent. Each fold line 304 terminates at a cut 306 and is separated from perforation lines 332 by a cut 306 and a fold line 302. Fold lines 302 are perpendicular to the perforation lines 232.

Figure 5:
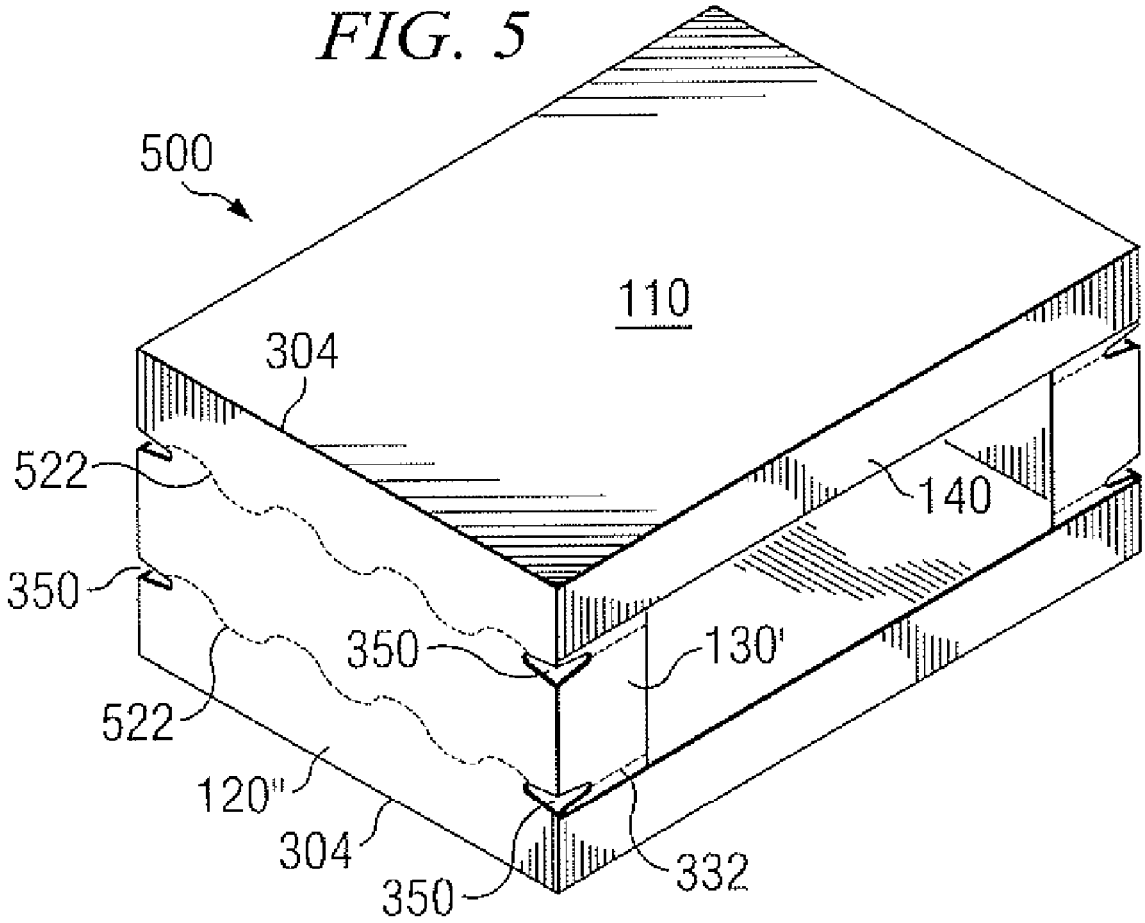
FIG. 5 depicts a shipping and display carton according to an alternate embodiment of the invention.

FIG. 5 shows a shipping and display carton 500 according to an alternate embodiment of the invention. This design has perforation lines 332 and precut holes 350 on flap 130', but the perforated lines 422 on end panel 120" curve up and down, similar to a sine wave. In such a manner, the perforated lines 422 are not parallel to the edges of the carton, which are formed at fold lines 304.

Two specific embodiments of the invention have been disclosed. However, one of ordinary skill in the art will recognize that one can modify the dimensions and particulars of the carton, as well as the specific design of the perforated lines, without straying from the inventive concept.

What is claimed is:

1. A method of making a carton for shipping and displaying a product, said method comprising:

a) forming a cardboard blank for a carton, said forming step comprising the steps of:

cutting a sheet of cardboard to form a blank for a carton, forming a plurality of fold lines in said blank, forming a plurality of perforated lines and precut openings in said blank that define an opening line by which adjacent portions of said carton can be separated;

b) folding said blank into a desired shape; and c) fastening at least one portion of said blank to a second portion of said blank to hold said blank in said desired shape;

wherein said opening line crosses at least one fold line of said carton;

wherein any portion of said opening line that crosses a fold line of said carton is formed by a precut opening.

2. The method of claim 1, wherein said step c) comprises gluing a first flap to a second.

3. The method of claim 1, wherein said step a) comprises cutting a sheet of corrugated cardboard.

4. The method of claim 1, wherein said perforated lines formed in said step a) do not parallel adjacent ones of said fold lines formed in said step a).

5. The method of claim 1, wherein step a) provides that at any point where two of said perforated lines intersect, an opening is cut.

6. The method of claim 1, wherein step a) provides that each of said perforated lines begins with a lead perforation having a length of ½ to 1 inch.

7. The method of claim 1, wherein the perforations and lands of said perforated lines created in step a) are ⅛ to ½ inches in length, with the exception of a lead perforation, which is longer.

* * * * *